United States Patent [19]

Moore

[11] Patent Number: 4,691,624

[45] Date of Patent: Sep. 8, 1987

[54] CHIMNEY FLUE COVER

[76] Inventor: Denny L. Moore, R.R. 2, Box 62C, Moberly, Mo. 65270

[21] Appl. No.: 790,405

[22] Filed: Oct. 23, 1985

[51] Int. Cl.[4] ..... F23L 17/02

[52] U.S. Cl. ..... 98/59; 126/286; 126/288

[58] Field of Search ..... 98/59; 126/286, 288

[56] References Cited

U.S. PATENT DOCUMENTS

| | | | |
|---|---|---|---|
| 3,377,939 | 4/1968 | Sailors | 98/59 |
| 4,368,663 | 1/1983 | Tabacco | 98/59 |
| 4,528,897 | 7/1985 | Homolik | 98/59 |

*Primary Examiner*—Harold Joyce

*Attorney, Agent, or Firm*—Kokjer, Kircher, Bradley, Wharton, Bowman & Johnson

[57] ABSTRACT

A chimney cover which is hinged to the top of a fireplace flue for opening and closing movement. A mounting bracket is clamped to the top of the flue liner by tightening machine screws against the flue tile without the need to drill holes or otherwise deform the flue liner. A hinge bracket connected with the flue cover is hinged to the mounting bracket by a hinge pin which receives a torsion spring. The torsion spring is loaded in compression to continuously urge the cover toward its open position. A cable extends from the cover through the flue to the fireplace so that the cover can be opened and closed from the fireplace.

2 Claims, 4 Drawing Figures

CHIMNEY FLUE COVER

BACKGROUND OF THE INVENTION

This invention relates generally to chimney caps and more particularly to a flue cover which acts to tightly close the top of a chimney flue but which can be opened to accommodate egress of smoke.

U.S. Pat. No. 4,528,897 to Homolik discloses a chimney cap which is mounted on top of the chimney flue and can be opened and closed at the fireplace by manipulating a cable which extends through the flue. Chimney caps of this type are more effective in preventing the leakage of air than conventional fireplace dampers because they are able to seal more tightly against the flue. A cover mounted at the top of the flue is also able to prevent rain, snow, insects, birds, small animals, leaves, dirt and other materials from entering the flue. When a fire is burning in the fireplace, the flue cover is opened and can be adjusted to allow the fire to burn at the desired rate. When there is no fire burning, the flue cover should be closed to prevent inside air from escaping and to prevent undesirable materials from entering the chimney.

Despite these benefits, the chimney cap shown in the Homolik patent suffers from a number of problems that have detracted from its commercial success. Perhaps most notably, the spring which opens the device is a simple tension spring which is placed under tension during the great majority of the time when the flue cover is closed. Consequently, the spring is particularly susceptible to being permanently set such that it loses its spring force. Once this occurs, the spring cannot exert enough force on the cover to open properly when the cable is released. The problem of permanent spring set requires frequent replacement of the spring, and this in turn requires work on the roof which can be a dangerous situation. If the spring has set or is not functioning properly for another reason, the user may release the cable and assume that the cover has opened when in fact the spring is not able to open it. If a fire is then started with the cover remaining closed, obvious problems result from the lack of an escape route for the smoke and flue gases.

Another serious problem with the Homolik chimney cap is that it is difficult for many homeowners to install. Mounting of the device requires that the flue tile be drilled so that bolts can be extended through the drill holes to secure the mounting plate in place on the flue. This drilling operation is difficult to carry out accurately and results in permanent holes through the flue tile. Moreover, the holes can weaken the flue tile and in some cases cause it to crumble, crack, or otherwise fail.

The Homolik device is also constructed in a relatively weak manner, especially in the area of the hinge. The cover is hinged to the mounting plate by small tabs which are welded to the plate and thus subject to breaking or bending due both to their small size and to the fact that the welds may fail. The hinge linkage is also welded to the flue cover and this connection is thus particularly susceptible to failure. These structural problems are aggravated by the extreme temperature variations to which the chimney cover is subjected. It is heated to a high temperature in the summer and also in the winter when a fire is burning in the fireplace. Snow, ice and extreme cold create problems in the winter. Due to these temperature fluctuations, the parts can warp and become brittle as a result of thermally induced expansion and contraction, and the device often fails completely or at least loses its ability to provide an air tight seal against the top of the flue.

SUMMARY OF THE INVENTION

The present invention is directed to a chimney flue cover which is improved in a number of respects in comparison to the Homolik device and all other known chimney covers. In accordance with the invention, a hinged flue cover is mounted on top of the chimney and can be opened and closed from the fireplace by manipulation of a cable which extends through the flue. The mounting arrangement includes a specially constructed mounting bracket which has its body located out of the flue but includes a flange plate which extends down into the flue. The flange plate is provided with three machine screws which can be tightened against the inside of the flue liner to rigidly clamp the mounting bracket in place without penetrating or otherwise deforming the flue tile.

The sturdy construction of the hinge for the flue cover is an important feature of the invention. The hinge mechanism includes a hinge bracket which is bolted to the cover and which has a pair of integral hinge plates that fit flatly against a pair of side plates formed as integral parts of the mounting bracket. A horizontal hinge pin pivotally connects the hinge plates with the side plates so that the cover can pivot open and closed. The sturdy construction of the side plates and hinge plates and the lack of any welded joints provides a hinge which is able to readily withstand the forces which are applied to it and the temperature changes to which it is subjected. At the same time, the hinge permits free opening and closing movement of the flue cover and allows the cover to seal against the flue in an air tight manner when closed.

An additional feature which is important to the invention is the use of a torsion spring to bias the cover toward its open position. The torsion spring is loaded in compression when the cover is closed and is considerably stronger than a tension spring. Therefore, the torsion spring is much less susceptible to being permanently set or to fail in fatigue due to repeated cycling. The torsion spring is also well shielded for the elements by the parts of the hinge mechanism which mounts the cover on the flue. The torsion spring typically lasts as long as the rest of the parts of the assembly and functions in a reliable manner to assure opening of the cover when the cable is released.

DESCRIPTION OF THE DRAWINGS

In the accompanying drawing which forms a part of the specification and is to be read in conjunction therewith and in which like reference numerals are used to indicate like parts in the various views.

DETAILED DESCRIPTION OF THE INVENTION

Figures 1, 2, 3, 4:
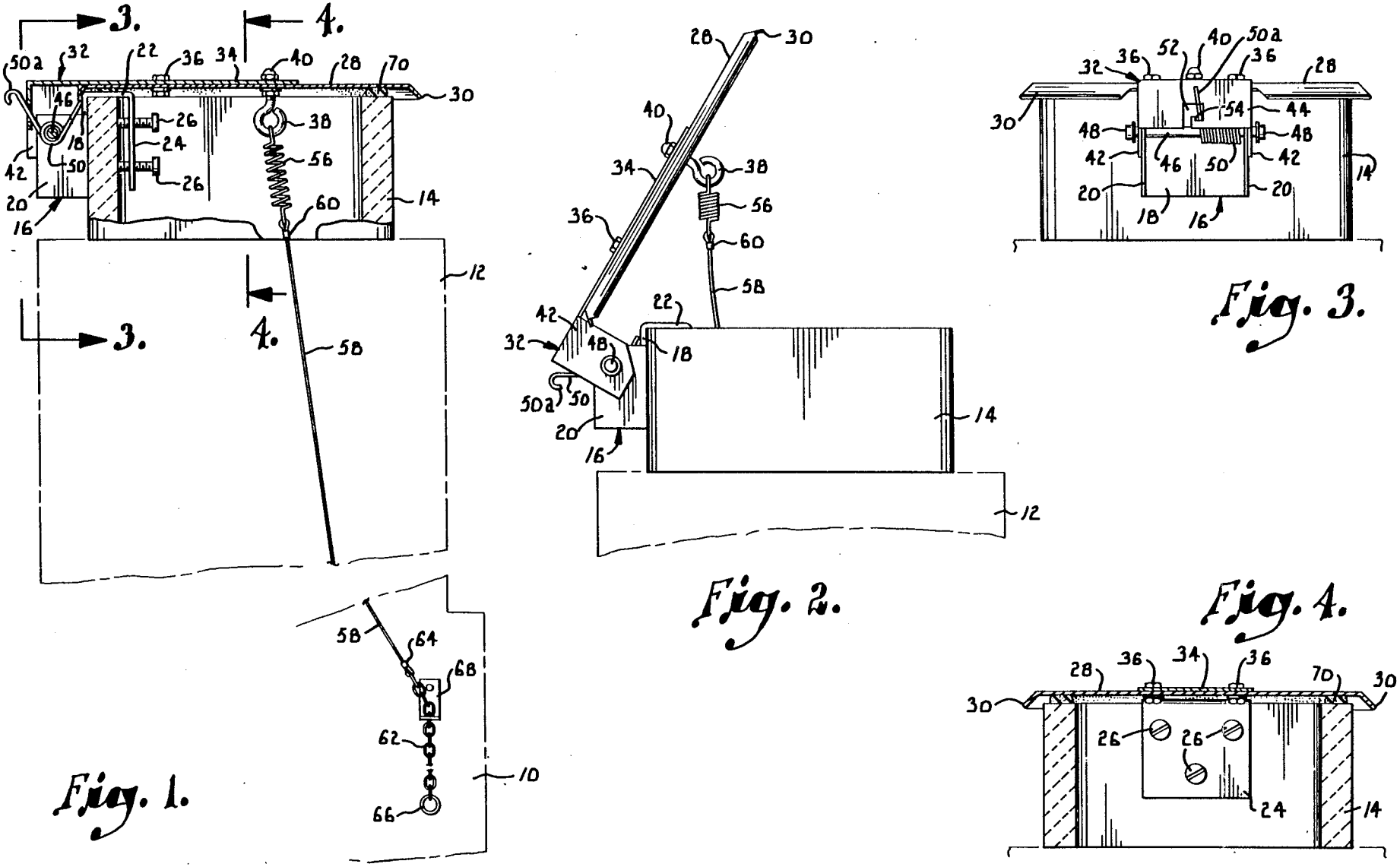
FIG. 1 is a side elevational view showing a chimney flue equipped with a flue cover constructed according to a preferred embodiment of the present invention, with the flue cover and flue shown in section and the cover in its closed position.
FIG. 2 is a side elevational view similar to FIG. 1 but showing the flue cover in its fully opened position.
FIG. 3 is a rear elevational view of the cover taken generally along line 3—3 of FIG. 1 in the direction of the arrows.
FIG. 4 is a fragmentary sectional view taken generally along line 4—4 of FIG. 1 in the direction of the arrows.

Referring now to the drawing in more detail and initially to FIG. 1, a conventional fireplace 10 has a chimney 12 which encloses a flue passage lined by a flue liner formed by ceramic tiles 14 connected end to end. The uppermost flue tile 14 projects above the top of the chimney 12.

In accordance with the present invention, a rigid mounting bracket 16 is secured to one side of the uppermost flue tile 14. The body of the mounting bracket 16 is located outside of the flue tile and includes a flat plate 18 and a pair of parallel side plates 20 which project outwardly from the side edges of plate 18. Plate 18 extends along the outside surface of the flue tile 14 and is integral at its top edge with a bridge portion 22 of the mounting bracket. The bridge portion 22 spans the upper edge of the flue tile and is integral with a vertical plate 24 which projects downwardly into the flue tile, as best shown in FIG. 1. Plates 18 and 24 are parallel to one another and are spaced apart a distance greater than the wall thickness of the flue liner 14. Bracket 16 is formed in a single integral piece.

Plate 24 is provided with three threaded openings which receive three machine screws 26. The machine screws 26 have blunt leading ends and slotted heads. In order to mount bracket 16 securely in place on the flue tile 14, the screws 26 are tightened against the inside surface of the flue liner. When the screws are fully tightened, plate 18 is drawn firmly against the outside surface of the flue liner in opposition to the screws, and this securely clamps bracket 16 on the flue liner adjacent its top end.

A cover 28 is hinged to the mounting bracket 16 and acts to open and close the chimney flue. Cover 28 is a generally square plate formed from sheet metal and having a size to cover the top of the flue tile 14. Flanges 30 are turned downwardly at an angle from the edges of the cover 28.

Cover 28 is hinged to the mounting bracket 16 by a hinge bracket 32. The hinge bracket 32 includes a flat tongue 34 which overlies cover 28 and is secured thereto by a pair of bolts 36 and also by an eye bolt 38 which receives a cap nut 40. A pair of parallel hinge plates 42 extend downwardly on the back portion of bracket 32. The hinge plates 42 are parallel to one another and fit against the outside surfaces of the side plates 20 of the mounting bracket. A flange 44 extends between the back edges of the hinge plates 42. Tongue 34 is integral with the hinge plates 42 and flange 44.

A horizontal hinge pin 46 pivotally connects hinge bracket 32 with the mounting bracket 16. Pin 46 extends through the hinge plates 42 and the side plates 20 and is provided with caps 48 on its opposite ends to prevent it from sliding out of place. Pin 46 connects cover 34 with the chimney flue so that the cover can pivot about the horizontal axis of the hinge pin between the fully open position shown in FIG. 2 and the fully closed position shown in FIG. 1.

The cover 34 is continuously urged toward the open position by a torsion spring 50 which is coiled around the hinge pin 46. Spring 50 extends substantially between the side plates 20 of bracket 16. One end of spring 50 rests against plate 18 of the mounting bracket. The opposite end of the torsion spring is hooked at 50*a*. With one end of the spring disposed against plate 18 and the spring in its relaxed condition, the hooked end is raised into a slot 52 formed in flange 44 of the hinge bracket 32. The hooked end of the spring is manipulated into a notch 54 formed at the base of slot 52, and the hooked end of the spring remains seated in the notch to prevent it from inadvertently slipping out of the slot. This results in the torsion spring 50 being loaded in compression such that it continuously acts against the hinge bracket 32 in a manner to urge bracket 32 and cover 28 to rotate in a counterclockwise direction as viewed in FIGS. 1 and 2. The lower edge of flange 44 engages the back edges of plates 20 to prevent the cover from pivoting open beyond the position shown in FIG. 2.

The eye bolt 38 projects below cover 28 and receives one end of a tension spring 56. A flexible cable 58 is looped around the opposite end of spring 56 and secured by a cable clamp 60. Cable 58 extends through the chimney flue and into the fireplace 10. The bottom end of cable 58 is looped through a link on one end of a chain 62 and secured by another cable clamp 64. The opposite end of chain 62 carries a ring 66 which serves as a finger pull.

An L-shaped bracket 68 is secured to the fireplace wall and is provided with a key hole slot (not shown) through which chain 62 extends. When the chain is located in the small portion of the key hole slot, it is locked against upward movement. When the chain is moved into the large portion of the key hole slot, it is free to move upwardly.

Installation of the flue cover involves first applying the mounting bracket 16 to the flue tile 14 and then tightening of the machine screws 26 in order to secure the mounting bracket in place. It is noted that mounting of the flue cover does not require the drilling of any holes or any other deformation of the flue tile 14. After the mounting bracket has been installed, the cable 58 is dropped through the flue, and pin 46 is installed to connect cover 28 to the mounting plate. The torsion spring 50 can then be loaded by inserting its hooked end into slot 52 until it seats in the notch 54. Preferably, a bead 70 of silicone, caulk, or another suitable material is applied to the top edge of the flue tile 14 in order to enhance the effectiveness of the seal between cover 28 and the flue.

In use, spring 50 normally causes cover 28 to move to the fully opened position. When a fire is burning in the fireplace 10, cover 28 is opened or at least partially opened if it is desired to control the rate at which the fire burns. To partially close the cover, chain 62 is pulled until the cover has reached the desired partially closed position, and chain 62 is then inserted into the narrow portion of the key hole slot in bracket 68. The cover can be fully closed by pulling chain 62 as far as possible and then inserting it into the narrow portion of the key hole slot. The spring 56 allows the cable assembly to give somewhat in order to accommodate any irregularities that may be present. The cover can be opened again simply by moving chain 62 into the large portion of the key hole opening so that the force of spring 50 causes the cover to automatically open.

The cover should be closed whenever a fire is not burning in the fireplace. Its location on top of the flue prevents rain, snow, leaves, dirt, and birds, squirrels and other small animals from entering the flue. At the same time, cover 28 provides an air tight seal against the top of the flue to prevent heated or cooled inside air from escaping from the interior of the building.

It is contemplated that cover 28 will be closed the great majority of the time, since there is ordinarily a fire burning in the fireplace 10 only a small percentage of the time. Consequently, spring 50 is in a compressed condition the majority of the time. Since a torsion spring loaded in compression is not likely to permanently set or otherwise malfunction, spring 50 is not susceptible to becoming permanently set and functions reliably to open the flue cover whenever the cable is released. The provision of strong plate members on both components of the hinge mechanism results in the hinge being able to withstand the forces that are applied to it as well as the thermally induced expansions and contractions to which it is subjected. The bracket 16 and 32 are both formed in a single integral piece which avoids welded joints and the problems associated with welds.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. A chimney cap for opening and closing a fireplace chimney flue having a flue liner, comprising:

a mounting bracket having a body portion which includes a substantially flat plate member and a pair of spaced apart side plates integral with said plate member and extending therefrom generally parallel to one another, said mounting bracket also including a plate element oriented substantially parallel to said plate member and a bridge portion integral with and interconnecting said plate member and said plate element, said moutning bracket being applicable to the flue liner with said plate member adjacent an outside surface of the flue liner, said plate element adjacent an inside surface of the flue liner and said bridge portion spanning an upper edge of the flue liner;

means for clamping said bracket rigidly on the flue liner without permanently deforming same;

a cover having a size to cover the flue;

a hinge bracket connected with said cover and including a flat tongue portion overlying and secured to the cover and a pair of spaced apart hinge plates located adjacent said side plates of the body portion of said mounting bracket, said hinge plates terminating in back edges and said hinge bracket also including a rigid flange extending between said back edges of the hinge plates;

a substantially horizontal hinge pin connecting said hinge plates with said side plates in a manner to mount said cover for pivotal movement about the axis of the hinge pin between an open position wherein the flue is open and a closed position wherein the flue is covered by said cover;

a torsion spring soiled around said hinge pin and generally enclosed by said side plates at the ends, said plate member at the front, said flange at the back and said tongue at the top, said torsion spring being loaded in compression when the cover is closed and having opposite ends acting against said plate member and flange, respectively, to continously urge said cover toward the open position; and cable means coupled with said cover and extending through the flue into the fireplace for opening and closing the cover.

2. The invention of claim 1, wherein said clamping means includes a plurality of threaded fasteners each having a threaded connection with said plate element of the mounting bracket and each having one end engageable with an inside surface of the flue in opposition to said plate member of the mounting bracket, whereby tighteneing of said fasteners against the inside surface of the flue clamps said plate member against the flue to rigidly secure said mounting bracket thereto.

* * * * *